United States Patent [19]

Eventoff

[11] 3,978,617

[45] Sept. 7, 1976

[54] SELF-CLOSING REFRIGERATOR DOOR

[76] Inventor: Arnold T. Eventoff, 243 N. Ridge St., Port Chester, N.Y. 10573

[22] Filed: May 1, 1975

[21] Appl. No.: 573,752

[52] U.S. Cl. ..... 49/404; 49/425; 49/453; 16/78

[51] Int. Cl.[2] ..... E05D 15/06

[58] Field of Search ..... 49/404, 425, 453, 445, 49/181, 420, 446; 16/72, 75, 78, 63, 67, 84

[56] References Cited

UNITED STATES PATENTS

| | | | |
|---|---|---|---|
| 2,595,016 | 4/1952 | Spector et al. | 49/453 X |
| 3,135,014 | 6/1964 | Martin | 49/181 X |
| 3,143,773 | 8/1964 | Glenn | 16/78 X |
| 3,760,535 | 9/1973 | Trulaske | 49/404 X |
| 3,837,119 | 9/1974 | Conneally et al. | 16/78 X |

*Primary Examiner*—Kenneth Downey
*Attorney, Agent, or Firm*—Joseph J. Orlando

[57] ABSTRACT

A self-closing refrigerator door of the sliding type having an upper channel into which is received a track depending from the upper portion of the door frame, a series of rollers supporting the door on a track projecting from the lower portion of the door frame, adjustable energy producing closing means having means releaseably engageable with the lower portion of the door frame beneath the door so that upon opening a closing force is exerted upon the door by the biasing action of the energy producing closing means sufficient to cause it to close on the door frame.

19 Claims, 13 Drawing Figures

SELF-CLOSING REFRIGERATOR DOOR

The present invention relates generally to self-closing refrigerator doors of the sliding type used in food and beverage display cases in establishments such as supermarkets, grocery stores, and the like. More particularly, the present invention relates to an improvement in sliding refrigerator doors having energy producing closing systems activated by opening of the doors whereby the doors may be installed and removed more easily than heretofore.

Refrigerator doors of the type with which the present invention is concerned are well known in the industry and an excellent description of such can be found in U.S. Pat. No. 3,837,119, to Conneally et al., granted Sept. 24, 1974. The patent describes a door having thermal glass panels mounted therein and a door frame, both the door and the frame being formed of plastic. The door frame is mounted in the wall opening of the refrigeration unit and the doors are mounted on individual adjacent tracks which extend along the upper and lower portions of the door frame. The bottom of each door is provided with a series of rollers or wheels for supporting and guiding the door along the lower track of the door frame on which the door is mounted. An energy producing closure system is provided in each door which consists of an elastic member contained within a recess in the door on the side in the direction of opening. One end of the elastic member is secured to the door while the other end of the elastic member is attached to a cable which is guided to a fixed position on the door frame beneath the door. When the door is displaced to the open position the elastic member is stretched thus energizing the self-closing system. For aesthetic and safety purposes the recess within which is contained the elastic member and associated cable is covered with a snap-in plastic cover plate. Although such refrigerator doors are a significant improvement over the previous refrigerator door assemblies which opened outwardly about a hinge, one remaining problem relates to the installation and removal of the doors from the respective frames. When installing such a door it is necessary to manually secure the free end of the cable attached to the elastic member to the lower portion of the frame beneath the intended position of the door. Although this is not an extremely difficult task it nevertheless is a hindrance to the installation of the doors. In addition, when it is desired to remove a door from its frame it is necessary to manually disengage the end of the cable secured to the bottom portion of the door frame. Furthermore, in such prior art refrigerator doors there is no provision for easily adjusting the tension of the elastic member and thus the force generated for closing the doors. Thus, in order to adjust the amount of closing force supplied by the elastic member it is sometimes necessary to totally remove the door from the frame and disengage the cable from the bottom of the frame and reposition it thereon. Attempting to find the proper or desired closing force for a particular door can thus be a time consuming and tedious job.

It is, therefore, a primary object of the present invention to provide an improved self-closing refrigerator door of the sliding type which may be installed and removed from its frame without the necessity of any manipulation of the closing system and which also includes a means for adjusting the closing force produced by the closing system while the door is in the installed position in its frame.

The above objects, as well as others which will hereinafter become apparent, are accomplished according to the present invention by the provision of a self-closing refrigerator door of the sliding type having an upper channel into which is received a track depending from the upper portion of the door frame, a series of rollers supporting the door on a track projecting from the lower portion of the door frame, energy producing closing means in said door having means releasably engageable with the lower portion of the door frame beneath the door so that upon opening a closing force is exerted upon the door by the energized closing means sufficient to cause it to close on the door frame. Adjustment of the closing force is provided by means whereby adjustment of the energy producing closing means is accomplished while the door is in the installed position in the frame.

The present invention will be described and understood more readily when considered together with the embodiment shown in the accompanying drawings, in which.

Figure 1:
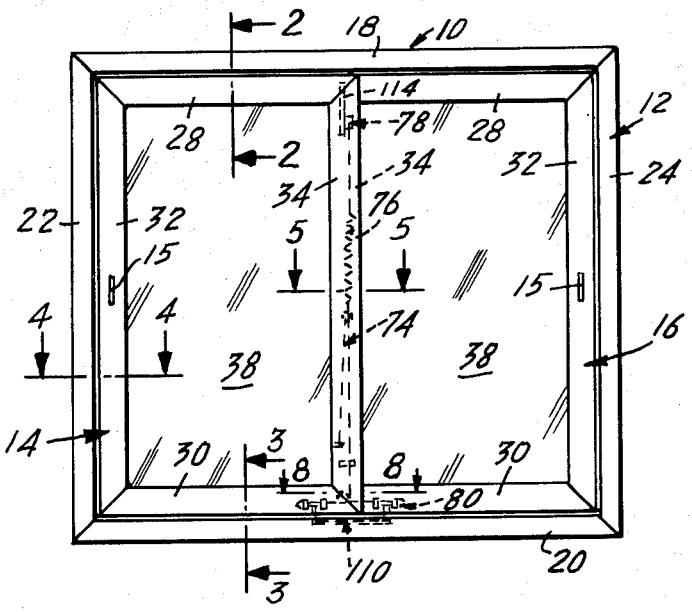
FIG. 1 is a front elevational view of a refrigerator door assembly according to the present invention.
Figure 2:
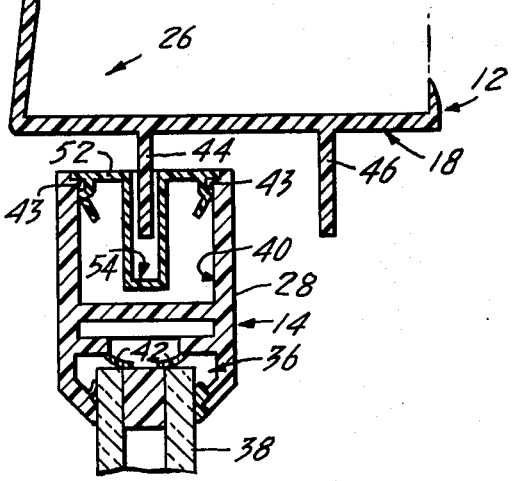
FIG. 2 is an enlarged, partial, cross-sectional view of the refrigerator door assembly of FIG. 1 taken along line 2—2 of FIG. 1.

Referring to the drawings, there is shown in FIG. 1 a refrigerator door assembly, generally designated 10, including a door frame 12 and two sliding doors, designated 14 and 16 respectively, mounted in frame 12. Doors 14 and 16 are provided with handles 15 for the purpose of opening the doors. Door frame 12 includes upper and lower door frame members, generally designated 18 and 20 respectively, and left and right side frame members, generally designated 22 and 24 respectively. Each of the door frame members are mounted in a wall opening, generally designated 26, of the refrigeration unit by any suitable means such as screws, etc.

Each of the doors 14 and 16 includes upper and lower rim members, designated 28 and 30 respectively, and side rim members, designated 32 and 34 respectively. As clearly seen in FIGS. 2 through 5, each of the rim members 28, 30, 32 and 34 are substantially of identical construction having an inner channel, designated 36, into which is fitted and secured the thermal window 38 or other such structure, and an outer channel, designated 40, the function of which will hereinafter be described. Each of the channels 36 is provided with means for supporting thermal window 38 such as resilient fingers 42 shown in the drawings. Each of the outer channels 40 in the respective rim members is provided with inwardly protruding lips or ledges, generally designated 43, which provide a means whereby a snap-in member may be secured to the outer channels 40 of rim members 28, 30, 32 and 34.

Doors 14 and 16 are mounted in frame 12 by means of upper and lower independent tracking systems which permit the doors to slide in frame 12. Thus, as clearly seen in FIGS. 2 and 3, upper frame member 18 is provided with independent depending parallel tracks, generally designated 44 and 46, and lower frame member 20 is provided with independent upstanding parallel tracks, generally designated 48 and 50. The upper rim member 28 of each of the doors 14 and 16 is provided with a snap-in cover, designated 52, which is engaged by lips 43 of channel 40. Snap-in covers 48 are provided with a recess or channel, designated 54, which is engaged by the respective depending tracks 44 and 46 of upper frame member 18. Each of the doors 14 and 16 are supported on upstanding tracks 48 and 50 by means of grooved wheels, designated 56, which are adapted to roll on wear-strips, designated 58, covering tracks 48 and 50.

Figure 4:
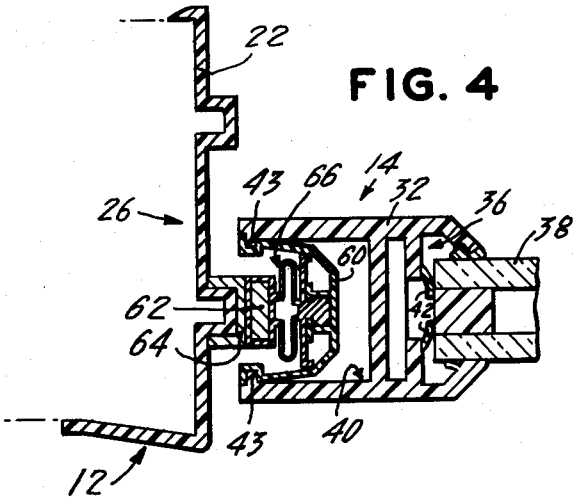
FIG. 4 is an enlarged, partial, cross-sectional view of the refrigerator door assembly of FIG. 1 taken along line 4—4 of FIG. 1.
Figure 3:
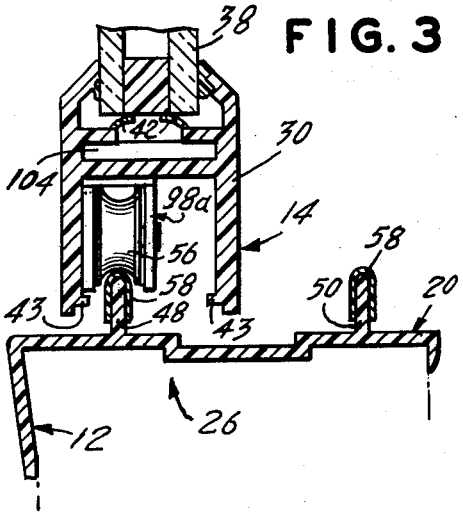
FIG. 3 is an enlarged, partial, cross-sectional view of the refrigerator assembly door of FIG. 1 taken along line 3—3 of FIG. 1.

Side rim members 32 of doors 14 and 16, located on the closing side of each door, are provided with snap-in covers, designated 60, which snap into outer channel 40 of the rim members by means of lips 43 as clearly seen in FIG. 4. Each of the snap-in covers 60 houses a magnet, generally designated 62, which is magnetically attractable to a metallic strip, generally designated 64, provided on side frame members 22 and 24. Magnet 62 may be supported on snap-in cover 60 by means of resilient member 66 which absorbs some of the impact when the refrigerator door closes.

Figure 5:
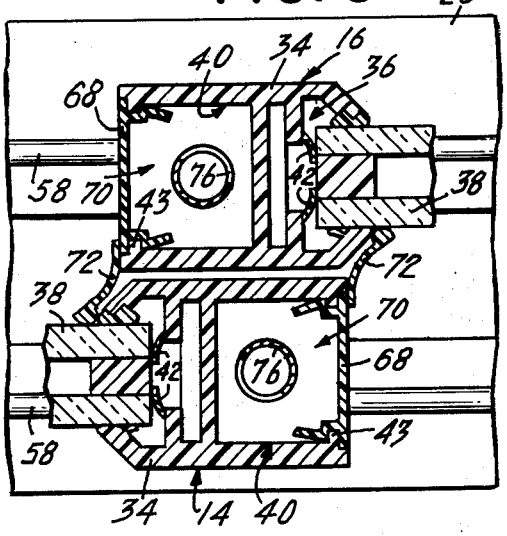
FIG. 5 is an enlarged, partial, cross-sectional view of the refrigerator door assembly of FIG. 1 taken along line 5—5 of FIG. 1.

The side of each of the doors 14 and 16 in the direction of opening, as clearly seen in FIG. 5, is provided with a snap-in cover generally designated 68, which snaps into, by means of lips 43, and covers channel 40 thereby defining a chamber generally designated 70, for housing the closing system provided for each door. Wiper seals, generally designated 72, are mounted on snap-in covers 68 for the purpose of reducing heat transfer between the overlapping portions of the doors 14 and 16.

Figure 6:
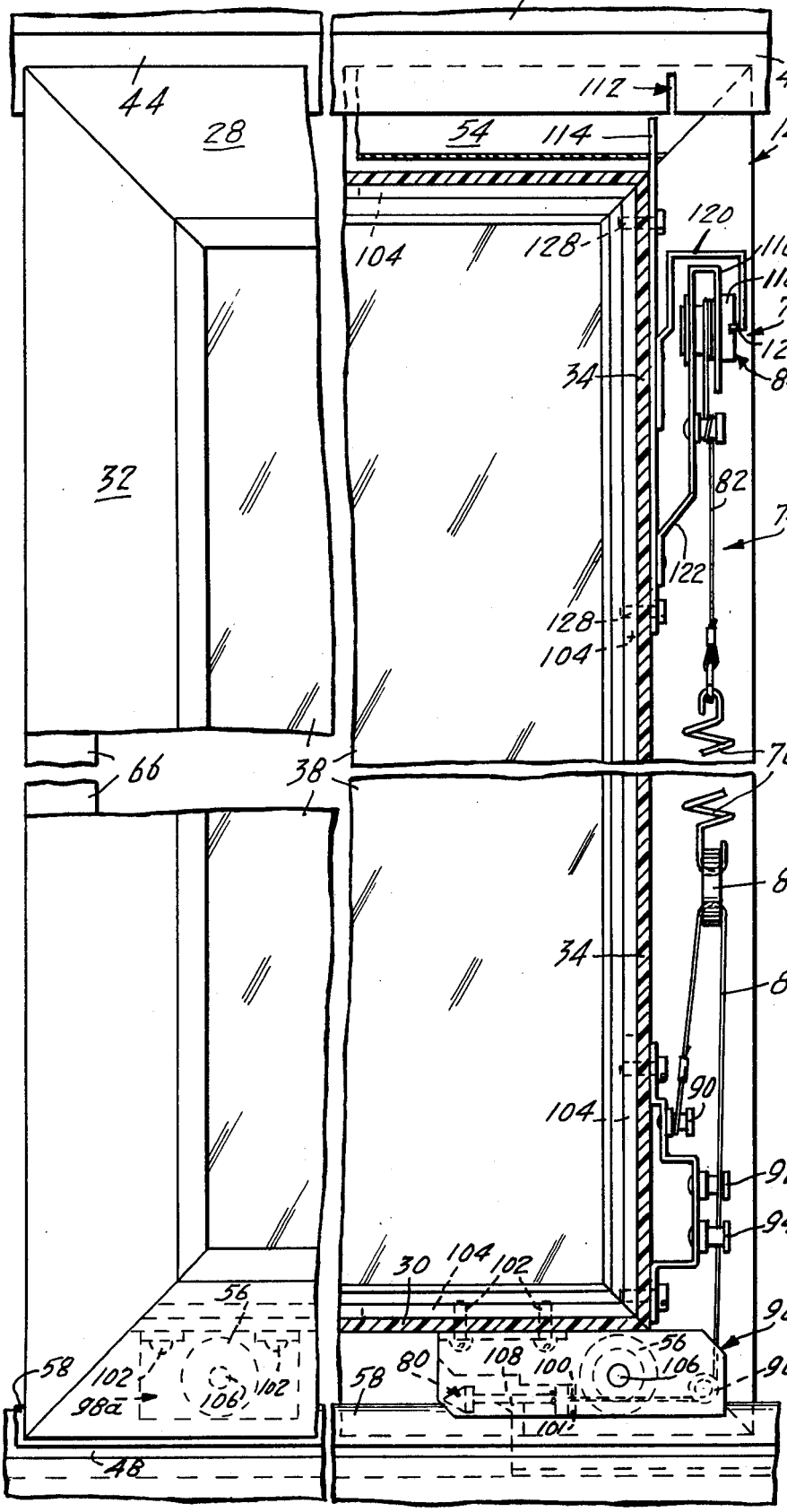
FIG. 6 is an enlarged, broken, front elevational view of a portion of the refrigerator door assembly of FIG. 1 wherein a portion of the front of the door is broken away to expose the closing system therefor.
Figure 7:
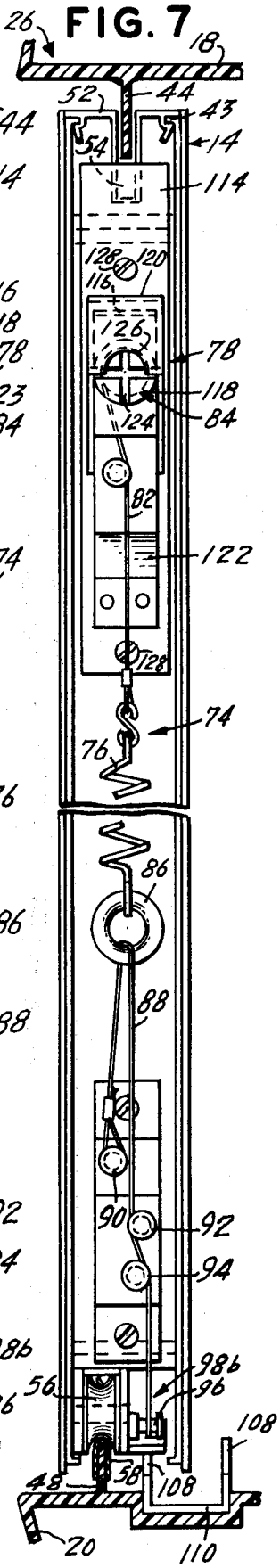
FIG. 7 is an enlarged, side elevational view of the portion of the refrigerator door assembly of FIG. 6, exposing the closing system therefor.
Figure 9:
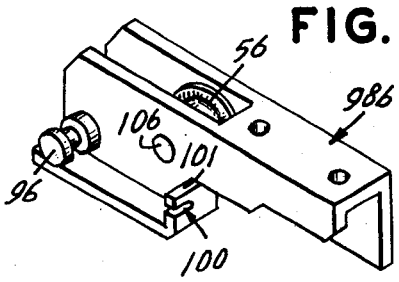
FIG. 9 is an enlarged perspective view of the roller housing used in conjunction with the closing system for supporting the refrigerator door of the present invention.

The closing system, generally designated 74, for door 14 is clearly depicted in FIGS. 6 and 7 and cooperates with rollers 56 to provide the self-closing feature of the door. Closing system 74 includes a means, such as elastic member 76, for producing a closing force which may be connected at one end to a ratchet type adjustment means, designated 78, and at the other end to a latching means or anchor, designated 80. Elastic member 76, which may be a spring having a low spring constant as shown or other suitable device, is connected to adjustment means 78 by means of a cable, designated 82, which is secured to a rotatable drum, designated 84, of adjustment means 78. The free end of elastic member 76 is attached to a doughnut shaped ring, generally designated 86. A cable, generally designated 88, which is secured at one end to side rim member 34 of door 14 at 90 passes through ring 86 and is connected at its other end to anchor 80 of elastic closing system 74. Bushings 92 and 94 are provided for the purpose of guiding and increasing the friction forces on cable 88. Cable 88 is guided to the underside of door 14 by means of friction bushing 96 attached to a roller housing, designated **98*b*. Ring 86 and bushings 92, 94 and 96 are all formed of a material such as a nylon for the purpose of imparting a frictional force to cable 88 to thereby result in a dampening effect on the closing force provided by elastic member 76. A transverse slot, designated 100, is provided in buttress 101 of roller housing 98*b* also for the purpose of guiding cable 88 and in conjunction with the biasing action of elastic member 76, provides a means for holding anchor 80 in a horizontally aligned position, as clearly seen in FIGS. 9 and 10. Roller housings 98*a* and 98*b* are secured to rim member 30 by means of bolts 102 which are secured to corner reinforcing member 104. Each of the roller housings 98*a* and 98*b* support shaft 106 of rollers 56 which rides on the track of lower frame member 20 thereby slideably supporting the refrigerator doors 14 and 16. Anchor 80, which is horizontally aligned as described above, is engageable with catch 108 which protrudes upwardly from bracket 110 secured to bottom frame member 20. Slot 112 in upper track 44 cooperates with tongue 114 which extends upwardly from the door and into channel 54 to thereby permit the installation and removal of door 14**.

Ratchet type adjustment means 78 is secured to rim member 34 of door 14 and comprises, in addition to rotatable drum 84, a bracket, generally designated 116, to which drum 84 is rotatably mounted, slotted head 118 on drum 84, U-shaped bracket 120, and tension member 122. U-shaped bracket 120 is provided at one end with prongs, designated 123, which engage with cross slots 124 in head 118, and because of the biasing action of tension member 122 serves to secure drum 84 and prevent it from uncontrollably rotating. As clearly seen in FIG. 7, bracket 120 is provided with a half moon shaped opening, designated 126, which permits access to slots 124. Tongue 114, bracket 116, bracket 120 and tension member 122 may all be secured to corner reinforcing member 104 by any suitable means such as screws 128.

Figure 10:
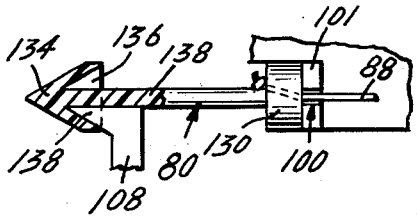
FIG. 10 is an enlarged view, partly in cross-section, of the means for releaseably engaging the elastic means to the door frame.

As clearly seen in FIG. 10, anchor 80 is provided with an enlarged portion, generally designated 130, to which is attached cable 88. Thus, anchor 80, because of the biasing of spring 76, abuts against buttress 101 which substantially prevents anchor 80 from being dislodged from its intended position. Anchor 80 is additionally provided with a stem portion, generally designated 132, which extends forwardly from enlarged portion 130 and terminates at head 134. Head 134 is provided at its stem end with a recess, designated 136, which is mateable with the forward extending, pointed portion 138 of catch 108. The frontal portion of head 134 is preferably conically shaped to permit relatching in the event anchor 80 somehow overrides catch 108.

Figure 11:
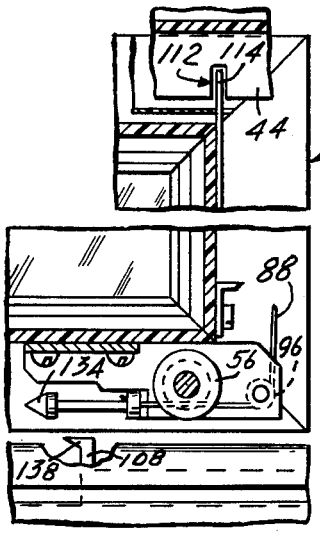
FIGS. 11 to FIGS. 13 are enlarged partial segments, having portions broken away, of the refrigerator door assembly of the present invention at various stages in the operation thereof.
Figure 12:
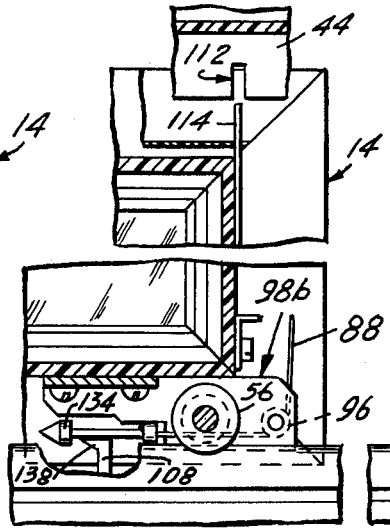
Figure 13:
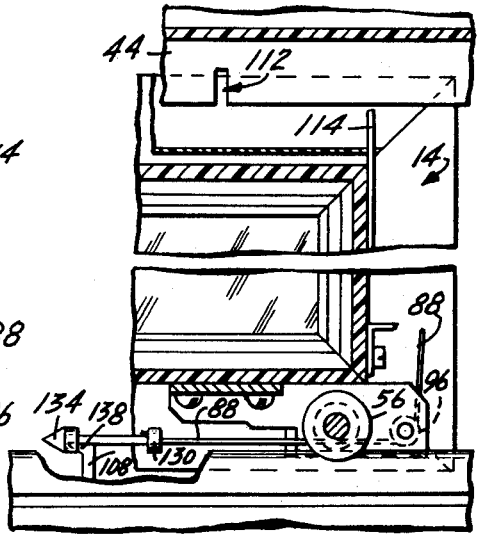
Figure 8:
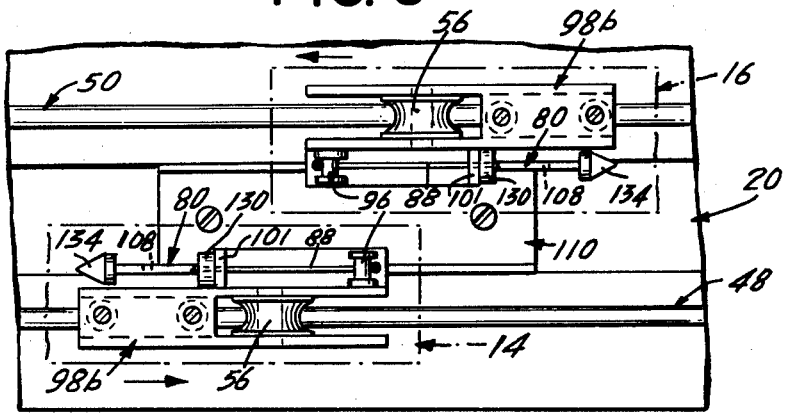
FIG. 8 is an enlarged, partial, plan view of the refrigerator door assembly of FIG. 1 taken along line 8—8 of FIG. 1.

FIGS. 11, 12 and 13 clearly depict installation of refrigerator door 14 and its self-closing operation. As clearly seen in FIG. 11, door 14 is installed by first aligning tongue 114 on door 14 with slot 112 in upper track 44. If in any other position, door 14 cannot be installed because of interference of tongue 114 with track 44 and, in addition, once the door has been installed it cannot be removed because of the interference of tongue 114 with track 44. Preferably, slot 112 and tongue 114 are so located on upper track 44 and door 14 respectively that when aligned, head 134 of anchor 80 is positioned forwardly of pointed portion 138 of catch 108 thereby facilitating the door's removal from frame 12, as clearly seen in FIG. 12.

In operation, handle 15 is grasped by the operator and a sufficient force exerted to overcome the tension of elastic member 76 and the frictional forces produced by the rolling action of the door to thereby slide the door to the open position as seen in FIG. 13. As clearly seen, the recess 136 in head 134 of anchor 80 engages the pointed portion 138 of catch 108 as the door is opened thereby securing anchor 80 in the fixed position shown and stretching elastic member 76. The stretching of elastic member 76 effectively energizes closing system 74. When the operator releases handle 15, energy stored in elastic 76 exerts a biasing closing force on the door causing it to slide to the closed position by means of rollers 56. It is to be noted in this connection that the securement of cable 88 to attachment 90 on rim member 34 through friction ring 86 rather than attaching it directly to elastic member 76 tends to cause the closing force exerted on door 14 to be of a more constant nature. In addition, the provision of bushings 92, 94 and 96 while guiding cable 88 also exert frictional forces on cable 88 as the door is being closed so as to tend to cause the closing force exerted on the door to be of a more constant nature. A sufficient momentum is imparted to the door to cause it to close without the added exertion of force in the last inch or so of travel and so anchor 80 may be disengaged from catch 108 as seen in FIG. 6.

Upon installing the door, or at any other time, it may be necessary to adjust the tension of elastic member 76. This is done according to the present invention by inserting a screw driver through opening 126 in bracket 120 to thereby engage slot 124 in slotted head 118. For this purpose an opening may be provided in snap-in cover 68 which is aligned with opening 126 in bracket 120. Slot 124 may then be disengaged from prongs 122 by exertion of a depressing force on the screw driver or other implement to depress bracket 116 against the biasing force of tension member 122. Rotatable drum 84 is then free to be rotated by means of the screw driver. The winding or unwinding of cable 82 on drum 84 causes the stretching or relaxing of elastic member 76 resulting in the increasing or decreasing, respectively, of the force exerted by elastic member 76.

It is to be understood that the foregoing general and detailed descriptions are explanatory of the present invention and are not to be interpreted as restrictive of the scope of the following claims. In particular, it should be pointed out that closing system 74 does not necessarily have to be mounted on the refrigerator door. Rather it can also be mounted on door frame 12 in which case the positioning of the components of the closing system will be reversed from the door to the frame and vice versa. Also, it can be appreciated that the closing system 74 can be positioned on the bottom of the refrigerator door rather than its side. It can, therefore, be understood that there are several ways of accomplishing the intended result while only one is herein described.

What is claimed is:

1. In a self-closing refrigerator door assembly of the sliding type having a frame mounted in a refrigerator wall opening, said frame having a pair of parallel adjacent tracks depending from the upper portion thereof and a pair of parallel adjacent tracks protruding from the lower portion thereof, inner and outer doors each having a channel in the upper portion thereof mateable with said depending tracks and each being supported on rollers, each of said doors being mounted on one of said pair of upper and lower tracks for translatory movement in said frame, a closing system for each door consisting of an energy producing closing means the biasing action of which is activated upon opening of said door, cable means attached to an end of said closing means, means for guiding said cable means to the underside of said door for engagement with the lower portion of said frame to thereby activate the biasing action of said energy producing closing means, the improvement comprising a latching means attached to the end of said cable means at the underside of said door and a catch secured to the lower portion of said frame engaged with said latching means when said door is in the open position and disengaged from said latching means when said door is in the closed position.

2. The self-closing refrigerator door assembly as defined in claim 1 wherein said latching means includes a substantially rigid member having a stem portion terminating in a head portion, the end of said cable means being attached to said stem portion, and said catch having an engaging means for engaging the head of said latching means when said door is in the open position.

3. The self-closing refrigerator door assembly as defined in claim 1 which further includes means for maintaining said latching means in alignment with said catch when said door is in the closed position whereby upon opening said door said latching means engages with said catch.

4. The self-closing refrigerator door assembly as defined in claim 3 wherein the means for maintaining said latching means in alignment with the engaging means of said catch comprises a buttress through which passes said cable means and against which the stem portion of said latching means abuts by means of the biasing action of said energy producing closing means.

5. The self-closing refrigerator door assembly as defined in claim 2 wherein the head portion of said latching means includes a recess girdling the stem portion of said latching means and the engaging means of said catch includes a protruding portion mateable with said recess.

6. The self-closing refrigerator door assembly as defined in claim 1 wherein each of the adjacent tracks depending from the upper portion of said frame is provided with a slot and each door is provided with a tongue extending into the channel in the upper portion of the door such that each door may be mounted in said frame or removed therefrom when the respective tongue and slot are aligned.

7. The sellf-closing refrigerator door assembly as defined in claim 1 wherein the energy producing closing means includes an elastic means secured at a first end to said door in the direction of opening and attached at a second end to said cable means.

8. The self-closing refrigerator door assembly as defined in claim 7 wherein the improvement further comprises a means for adjusting said elastic means, said adjusting means including a rotatable drum attached to the side of said door in the direction of opening to which is windably attached said first end of said elastic means and means releasably engageable with said rotatable drum for preventing rotation thereof, whereby upon release of said engaging means said first end of said elastic means may be wound or unwound on said rotatable drum by the rotation thereof to vary the stored energy in said elastic means.

9. The self-closing refrigerator door assembly as defined in claim 8 wherein said means releasably engageable with said drum comprises diametrically fixed prongs insertable at least one cross slot located in one end of said rotatable drum and biasing means biasing said drum so that said slotted end of said drum is engaged with said prongs whereby a suitable tool may be inserted into said slot between said prongs to unbias said drum and disengage said prongs from said slotted end of said drum and allow said drum to be rotatated.

10. In a self-closing refrigerator door assembly of the sliding type having a frame mounted in a refrigerator wall opening, said frame having a pair of parallel adjacent tracks depending from the upper portion thereof and a pair of parallel adjacent tracks protruding from the lower portion thereof, inner and outer doors each having a channel in the upper portion thereof mateable with said depending tracks and each being supported on rollers, each of said doors being mounted on one of said pair of upper and lower tracks for translatory movement in said frame, a closing system for each door including an elastic means secured at a first end to said door in the direction of opening, means for guiding said elastic means to the underside of said door for engagement with the lower portion of said frame, the improvement comprising a means for adjusting said elastic means, said adjusting means including a rotatable drum attached to the side of said door in the direction of opening to which is windably attached said first end of said elastic means and means releasably engageable with said rotatable drum for preventing rotation thereof, whereby upon release of said engaging means said first end of said elastic means may be wound or unwound on said rotatable drum by the rotation thereof to vary the stored energy in said elastic means.

11. The self-closing refrigerator door assembly as defined in claim 10 wherein said means releasably engageable with said drum comprises diametrically fixed prongs insertable into at least one cross slot located in one end of said rotatable drum and biasing means biasing said drum so that said slotted end of said drum in engaged with said prongs whereby a suitable tool may be inserted into said slot between said prongs to unbias said drum and disengage said prongs from said slotted end of said drum and allow said drum to be rotated.

12. In a self-closing door assembly of the sliding type having a frame mounted in a wall opening, said frame having a pair of parallel adjacent tracks depending from the upper portion thereof and a pair of parallel adjacent tracks protruding from the lower portion thereof, inner and outer doors each having a channel in the upper portion thereof mateable with said depending tracks and each being supported on rollers, each of said doors being mounted on one of said pair of upper and lower tracks for translatory movement in said frame, a closing system for each door including an elastic means secured at a first end to said door in the direction of opening, means for guiding said elastic means to the underside of said door for engagement with the lower portion of said frame, the improvement comprising a means for adjusting said elastic means, said adjusting means including a rotatable drum attached to the side of said door in the direction of opening to which is windably attached said first end of said elastic means and means releasably engageable with said rotatable drum for preventing rotation thereof, whereby upon release of said engaging means said first end of said elastic means may be wound or unwound on said rotatable drum by the rotation thereof to vary the stored energy in said elastic means.

13. In a self-closing door assembly of the sliding type having a frame mounted in a wall opening, said frame having a pair of parallel adjacent tracks depending from the upper portion thereof and a pair of parallel adjacent tracks protruding from the lower portion thereof, inner and outer doors each having a channel in the upper portion thereof mateable with said depending tracks and each being supported on rollers, each of said doors being mounted on one of said pair of upper and lower tracks for translatory movement in said frame, a closing system for each door consisting of an energy producing closing means the biasing action of which is activated upon opening of said door, cable means attached to an end of said closing means, means for guiding said cable means to the underside of said door for engagement with the lower portion of said frame to thereby activate the biasing action of said energy producing closing means, the improvement comprising a latching means attached to the end of said cable means at the underside of said door and a catch secured to the lower portion of said frame engaged with said latching means when said door is in the open position and disengaged from said latching means when said door is in the closed position.

14. A self-closing door assembly of the sliding type having a frame mounted in a wall opening, at least one door slideably mounted for translatory movement in said frame, an elastically energized closing system for said door consisting of an elastic means attached to the side of said door in the direction of opening, means for guiding a first end of said elastic means to the underside of said door for engagement with the lower portion of said frame, and means for adjusting said elastic means including a rotatable drum attached to the side of said door in the direction of opening to which is windably attached a second end of said elastic means and means releasably engageable with said rotatable drum for preventing rotation thereof, whereby upon release of said engaging means said second end of said elastic means may be wound or unwound on said rotatable drum by the rotation thereof to vary the stored energy in said elastic means.

15. The self-closing door assembly as defined in claim 14 wherein said means releasably engageable with said drum comprises at least one fixed prong insertable into a cross slot located in one end of said rotatable drum and biasing means biasing said drum so that said slotted end of said drum is engaged with said prong.

16. A self-closing refrigerator door assembly of the sliding type having a frame mounted in a refrigerator wall opening, at least one door slideably mounted for translatory movement in said frame, a closing system for said door consisting of an energy producing means the biasing action of which is activated upon opening of said door, cable means attached to an end of said closing means, means for guiding said cable means to the underside of said door, a latching means attached to the end of said cable means at the underside of said door, and a catch secured to the lower portion of said frame engaged with said latching means when said door is in the open position and disengaged from said latching means when said door is in the closed position.

17. The self-closing refrigerator door assembly as defined in claim 16 wherein said latching means includes a substantially rigid member having a stem portion terminating in a head portion, the end of said cable means being attached to said stem portion, and said catch having an engaging means for engaging the head of said latching means when said door is in the open position.

18. The self-closing refrigerator door assembly as defined in claim 16 which further includes means for maintaining said latching means in alignment with said catch when said door is in the closed position whereby upon opening said door said latching means engages with said catch.

19. The self-closing refrigerator door assembly as defined in claim 18 wherein the means for maintaining said latching means in alignment with the engaging means of said catch comprises a buttress through which passes said cable means and against which said latching means abuts by means of the biasing action of said energy producing closing means.

* * * * *